US007299738B2

(12) United States Patent
Thoms et al.

(10) Patent No.: US 7,299,738 B2
(45) Date of Patent: Nov. 27, 2007

(54) AXIAL PISTON MACHINE HAVING A DEVICE FOR THE ELECTRICALLY PROPORTIONAL ADJUSTMENT OF THE VOLUMETRIC DISPLACEMENT

(75) Inventors: Reinhardt Thoms, Neumunster (DE); Carsten Fiebing, Jevenstedt (DE); Bernd Hames, Henstedt-Ulsburg (DE); Martin Wüstefeld, Neumunster (DE)

(73) Assignee: Sauer-Danfoss Inc., Ames, IA (US)

( * ) Notice: Subject to any disclaimer, the term of this patent is extended or adjusted under 35 U.S.C. 154(b) by 411 days.

(21) Appl. No.: 11/106,218

(22) Filed: Apr. 14, 2005

(65) Prior Publication Data

US 2006/0008358 A1 Jan. 12, 2006

(30) Foreign Application Priority Data

Jul. 9, 2004 (DE) ..... 10 2004 033 376

(51) Int. Cl.
*F15B 13/00* (2006.01)

(52) U.S. Cl. ..... 91/506; 92/12.2

(58) Field of Classification Search ..... 91/506; 92/12.2; 74/839; 417/222.1
See application file for complete search history.

(56) References Cited

U.S. PATENT DOCUMENTS 3,812,765 A * 5/1974 Himmler ..... 91/506
4,478,136 A * 10/1984 Heiser et al. ..... 91/506
4,599,050 A * 7/1986 Ishizaki et al. ..... 417/222.1
4,600,364 A * 7/1986 Nakatani et al. ..... 417/222.2
4,756,157 A * 7/1988 Appel ..... 60/444
7,121,188 B2 * 10/2006 Thoms et al. ..... 91/506

* cited by examiner

*Primary Examiner*—Michael Leslie

(57) ABSTRACT

An axial piston machine having a swashplate or an oblique axis which can be adjusted by means of servopistons and has a valve segment and an adjustment unit for the electrically proportional adjustment of the volumetric displacement. The adjustment unit comprises proportional magnets which can be activated electrically, and a control piston for controlling the oil pressure which moves the servopistons. The proportional magnets act on the control piston along a common tappet axis, a feedback device for feeding back the current swashplate or oblique-axis valve-segment position to the control piston being provided. The feedback device comprises spring levers 6, 6' which can pivot about an axis, the spring levers 6, 6' each being mounted on the pivot axis 5 with a bearing shell 15, which are each composed of two component shells which support the spring lever 6, 6' at separate locations on the pivot axis 5, and which each essentially enclose a half-space about the pivot axis 5.

9 Claims, 6 Drawing Sheets a)

d)

AXIAL PISTON MACHINE HAVING A DEVICE FOR THE ELECTRICALLY PROPORTIONAL ADJUSTMENT OF THE VOLUMETRIC DISPLACEMENT

BACKGROUND OF THE INVENTION

The invention relates to an axial piston machine having a device for the electrically proportional adjustment of the volumetric displacement according to the features of Claim 1.

Axial piston machines such as hydraulic pumps and motors in an open or closed circuit and of swashplate design or oblique-axis design are often actuated using an electrically proportional adjustment. The input signal into this adjustment unit is an electric current. Its output signal is a hydraulic pressure. The outgoing oil pressure acts on servopistons of the axial piston machine which thus move along their movement axis. This movement is transmitted, for example, to a swashplate which, by changing its angular position, changes the volumetric displacement of the axial piston machine.

The current position of the swashplate or oblique axis is fed back to the electrically actuated adjustment unit via a mechanical feedback system. By means of this feeding-back of the position, the control circuit is closed and it is ensured that the volumetric displacement of the axial piston machine also behaves proportionally to the electric current at the adjustment unit. The system has a control piston which moves by means of at least one proportional magnet, but generally is displaced along its movement axis by two proportional magnets which are arranged opposite one another at its end faces, and as a result connects or disconnects ducts in such a way that oil is made available at a specific pressure for moving the servopistons. In known axial piston machines, a lever and spring system is provided for this purpose, which system ensures that the angle of the swashplate or of the valve segment in relation to the oblique axis is fed back to the control piston.

Known feedback mechanisms have structurally induced problems. On the one hand, any form of mechanical hysteresis between levers, springs and proportional magnets adversely affects the desired proportional adjustment characteristic owing to the sensitive equilibrium of forces, and on the other hand previous solutions require differently dimensioned adjustment devices depending on the overall size of the axial piston machine, which adjustment devices give rise to large overall widths in some cases owing to the lever mechanisms which are used. The proportional magnets are then a correspondingly large distance apart from one another. Since they are mounted at an exposed location on the axial piston machine, this increases their risk of damage and makes it inappropriate to use such adjustment units on axial piston machines with a small volumetric displacement and correspondingly small installation space.

The invention is based on the object of providing an axial piston machine having an improved adjustment system.

SUMMARY OF THE INVENTION

This object is achieved with the axial piston machine according to Claim 1. According to the invention, the axial piston machine has a swashplate which can be adjusted by means of servopistons, or in the case of an oblique-axis machine a corresponding valve segment, and an adjustment unit for the electrically proportional adjustment of the volumetric displacement, the adjustment unit comprising proportional magnets which can be activated electrically, and a control piston for controlling the oil pressure which moves the servopistons, and the proportional magnets acting on this control piston along a common tappet axis. A feedback device for feeding back the current swashplate or oblique-axis valve-segment position is provided. The feedback device comprises spring levers which can pivot about an axis. The spring levers are each mounted on the pivot axis with a bearing shell, which are each composed of two component shells which support the spring lever at separate locations on the pivot axis, each bearing shell essentially enclosing a half-space about the pivot axis.

In a further embodiment of the invention, the feedback device of the axial piston machine comprises a pointer which is embodied as a two-armed lever and which can pivot about the axis which is common to the spring levers, the pointer engaging in the control piston on one side of the pivot axis, and between the spring levers on the other side. As a result, a lever system which is largely free of tilting moments and with which the current swashplate position can be fed back reproducibly is obtained.

In order to reduce the frictional forces, the pointer can be mounted on the spring levers. In addition, the pointer head and the support faces of the spring levers on which the pointer rests are specially processed in a way which reduces friction, for example coated in a friction-reducing fashion. The pointer head may be of cylindrical or spherical construction or else have a rectangular cross section.

The end of the pointer which engages in the control piston is preferably guided, in spherical form, in a corresponding bore in the control piston, the point of engagement of the pointer in the control piston lying outside the centre line of the piston, so that the control piston is prevented from rotating. The point of engagement of the pointer in the control piston lies, here, on the tappet axis of the magnets, so that tilting moments are also avoided in this respect.

The control piston preferably has a longitudinal bore which can be formed centrally along the centre line of the control piston, in order to conduct away leakage oil, when there is an eccentric engagement of the pointer.

One particular advantage of the invention consists in the fact that an entire series of axial piston machines with different volumetric displacements can be covered with the adjustment device, it being possible to use one and the same adjustment device for all the models in the series.

Further refinements and advantages of the invention emerge from the following description of the figures.

DETAILED DESCRIPTION OF THE PREFERRED EMBODIMENT

Figure 1:
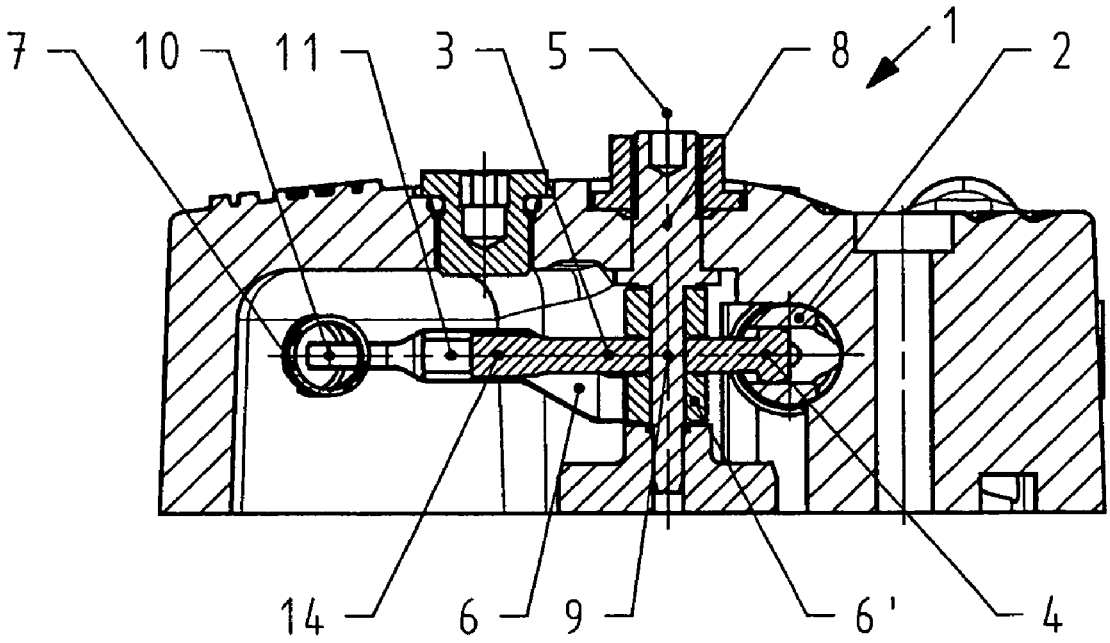
FIG. 1 shows the adjustment device of the axial piston machine in cross section.

FIG. 1 shows a cross section through the adjustment device 1. A control piston 2 is adjusted by means of proportional magnets along a movement axis perpendicularly to the cross section shown, with the result that an oil pressure which acts on the servopiston (not shown here) is made available. A pointer 3 which is embodied as a two-armed lever engages in the control piston 2, which, with its movement, rotates the pointer 3 about the pivot axis 5. The pointer 3 is guided, here, with a ball guide 4 in a bore in the control piston 2 outside its movement axis and centre line.

A respective spring lever 6, 6' is also mounted on the pivot axis 5, on each side of the pointer 3, this bearing being embodied in the form of bearing shells in such a way that tilting moments are avoided as far as possible. Such tilting moments can be produced by the forces which are exerted on the spring levers 6, 6' by the control piston 2 and by the traction spring 7 which stresses the spring levers one against the other. The bearing shells are embodied here in such a way that they are supported at separate locations on the axis.

The pivot axis 5 is formed by a pin-shaped, cylindrical axial bolt 8 which is mounted on each side in the housing and has an eccentric section 9 in its central part on which the spring levers 6, 6' and the pointer 3 are mounted. The eccentricity is dimensioned here such that, by rotating the axial bolt 8, the pivot axis 5 can be displaced sufficiently to be able to set the zero position. Owing to the small degree of offset, no particular distinction is made between the pivot axis 5 and the axis of rotation of the axial bolt 8 in the drawing.

The traction spring 7 is clamped into the fork-like ends 10—facing away from the pivot axis 5—of the spring levers 6, 6'. On the one hand the pointer head 14 rests on the bearing faces 11, 11' of the spring levers 6, 6', and if the bearing faces 11, 11' protrude beyond said pointer head 14, a pin (not shown) which is connected to the swashplate and which transmits the angular position of the swashplate to the spring levers 6, 6' also rests on them. The pivoting movement of said pin is directed essentially perpendicularly to the plane of the drawing in FIG. 1 here.

The control piston 2 has a defined home position. This position is brought about by the two spring levers 6, 6', the pointer 3 which is embodied as a two-armed lever, the traction spring 7, the pivot axis 5 and a connection to the swashplate, in the following way: the spring levers 6, 6' and the pointer 3 are mounted together on the pivot axis 5 in a rotatable fashion. In this arrangement, the spring levers 6, 6' are connected at their ends to a traction spring 7 which pulls the spring levers 6, 6' one against the other in the manner of a closing clamp, the spring levers 6, 6' enclosing one end of the pointer 3 and at the same time the mechanical contact with the swashplate, which is pressed into its home position by powerful spring forces. When the clamp is closed around the contact with the swashplate, the end of the pointer 3 which lies between the spring levers is also clamped in by the spring levers 6, 6', in such a way that its play between them is virtually zero. At its other end, the pointer 3 engages in the control piston 2 and thus holds it in its home position. In this home position, the control piston 2 does not conduct any oil to the servopiston, and the swashplate is held in the neutral position by powerful springs.

So that no oil is actually made available to the servopistons in the neutral position of the control piston 2, the position of the pointer 3, which, as a result of the spring levers 6, 6', is already aligned at one end in relation to the swashplate, has to be set appropriately. This is done by displacing the pivot axis 5.

If a sufficiently large electric current flows through 35 one of the proportional magnets 12, 12', the control piston is pushed along its movement axis by the tappet of the proportional magnet. This forces the pointer 3 to rotate about the pivot axis 5, and to spread apart the clamp formed from the spring levers 6, 6' and the traction spring 7. In the process, one spring lever 6 maintains mechanical contact with the swashplate, while the other spring lever 6' rotates in the same direction as the pointer 3 about the pivot axis 5, and thus moves out of mechanical contact with the swashplate.

As a result, owing to the movement of the control piston, oil is conducted to the servopistons of the axial piston machine and the swashplate is pivoted. The oil-conducting connections are expediently embodied in such a way that the movement of the swashplate by means of the mechanical contact with the spring lever 6, which is still in the resting position, causes the latter to rotate in the opposite direction to the other spring lever 6'. As a result, the stretched traction spring 7 pulls the spring lever 6'—previously deflected by the proportional magnet and the pointer 3—and the pointer 3 and control piston 2 back into their home position. In the process, the spring force and the force of the proportional magnet are balanced and a specific position of the swashplate is assigned to each force level.

Figure 2:
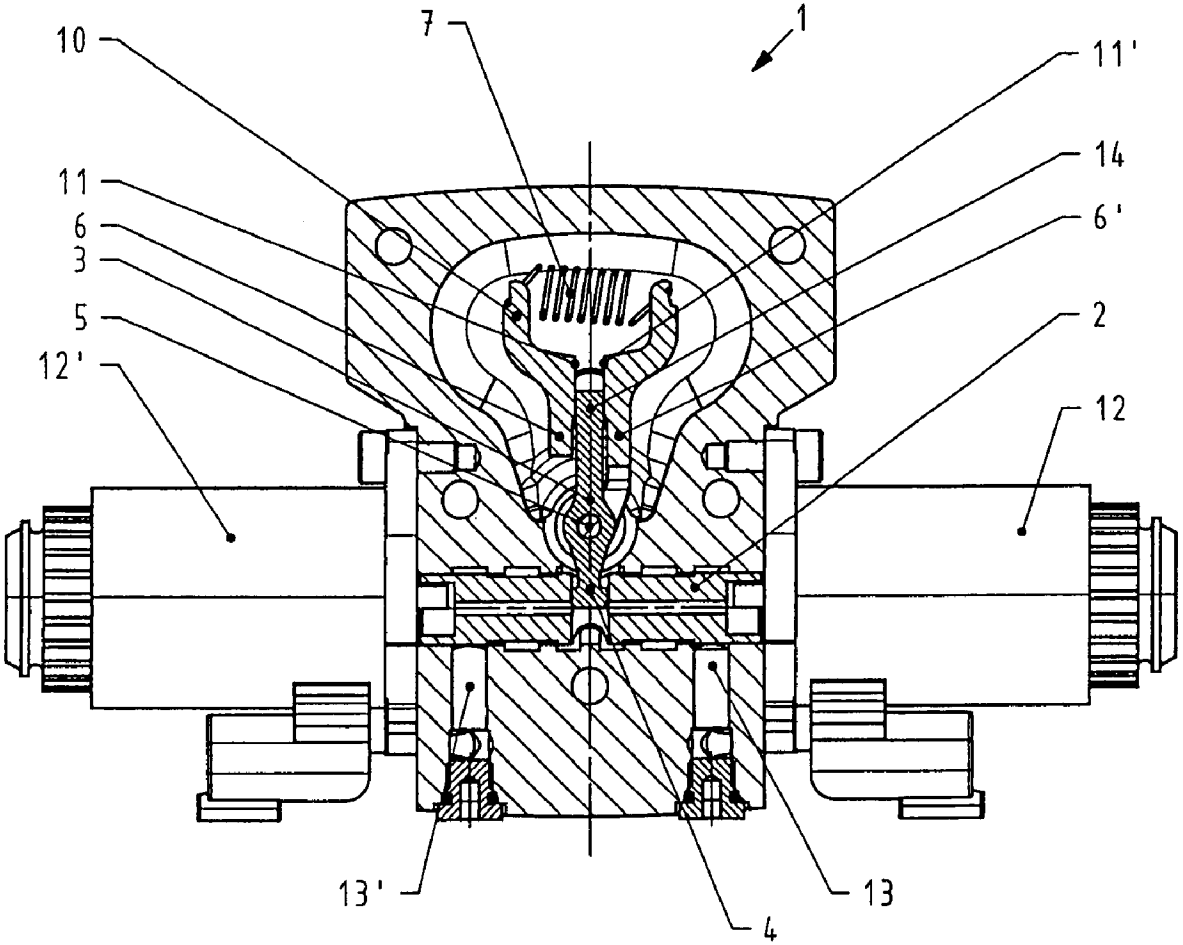
FIG. 2 shows the adjustment device of the axial piston machine in a section which is perpendicular to FIG. 1, and FIGS. 3*a*, 3*b*, 3*c* and 3*d* show the bearing of the spring levers and of the pointer according to one preferred embodiment of the invention.
Figure 3:
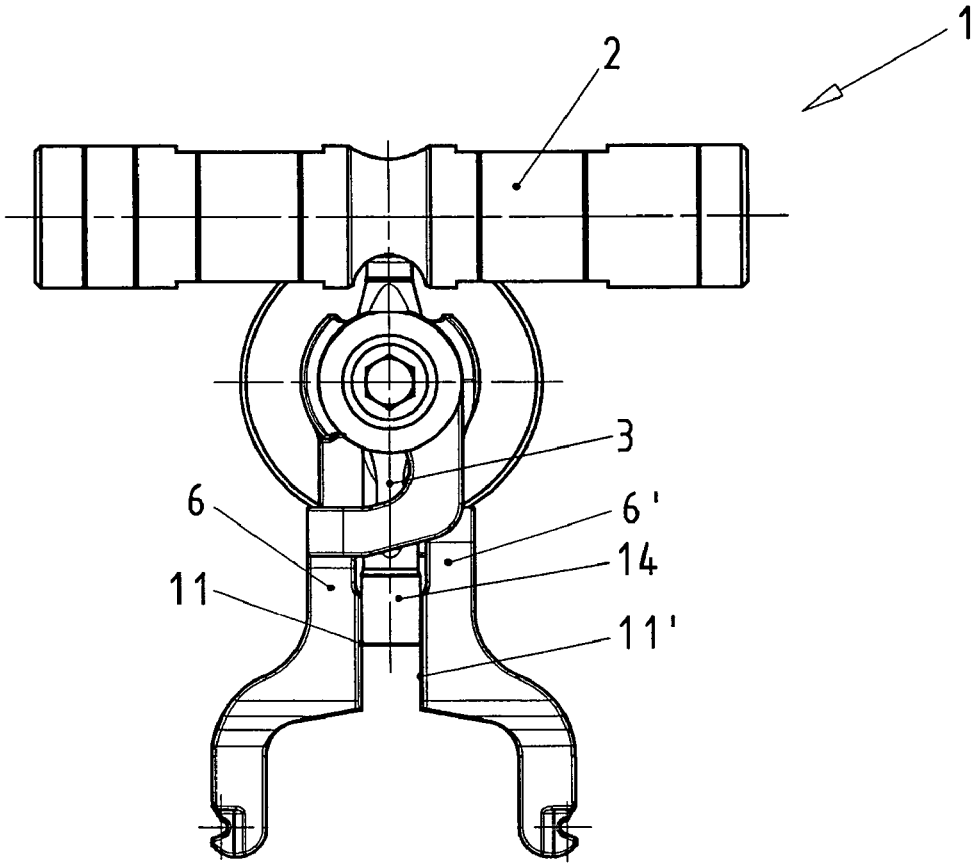
Figure 3:
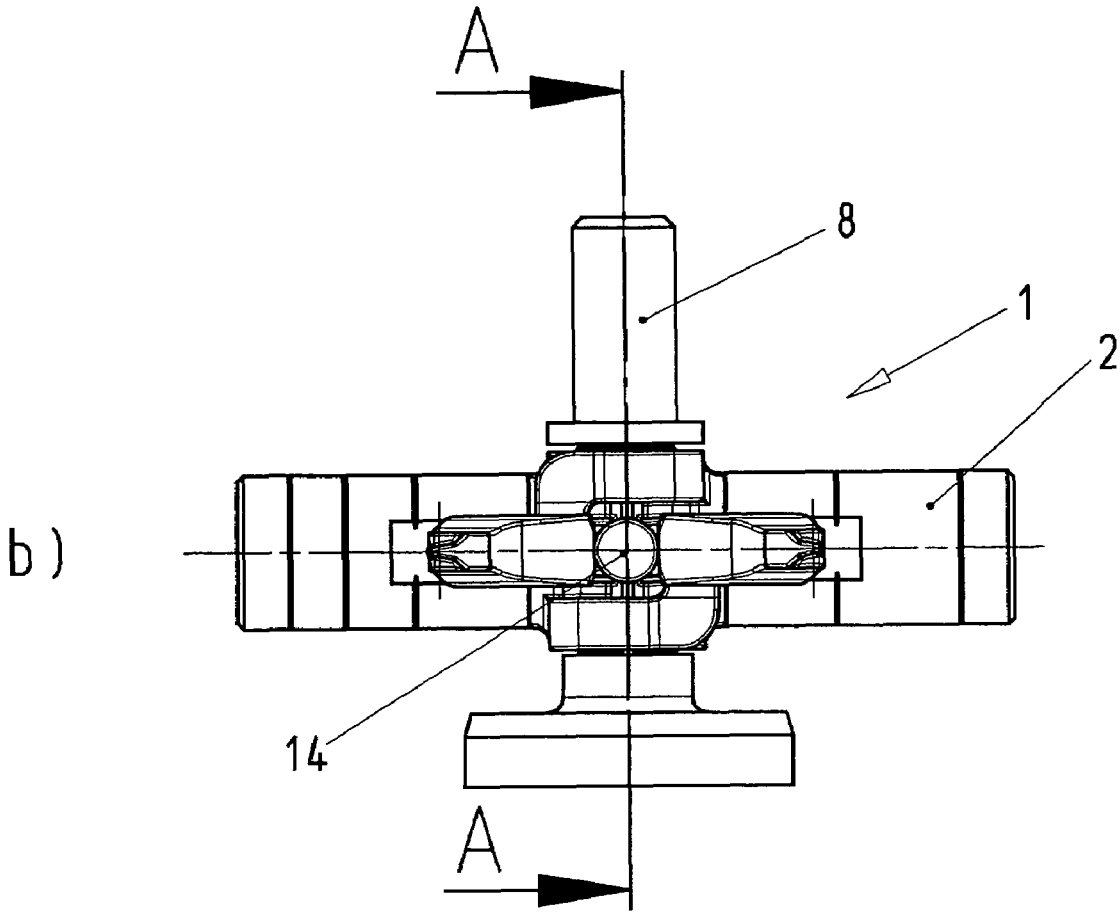
Figure 3:
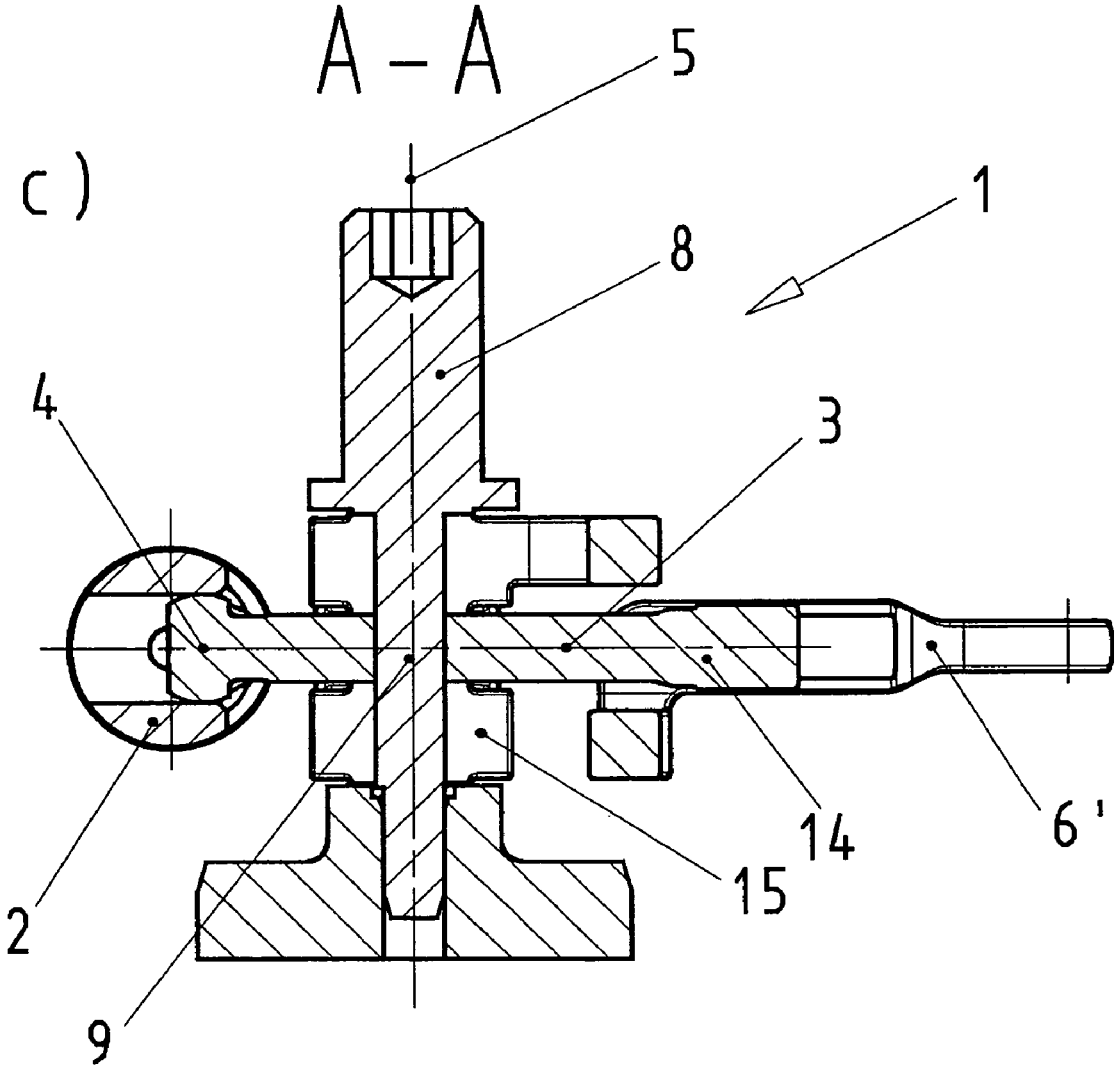
Figure 3:
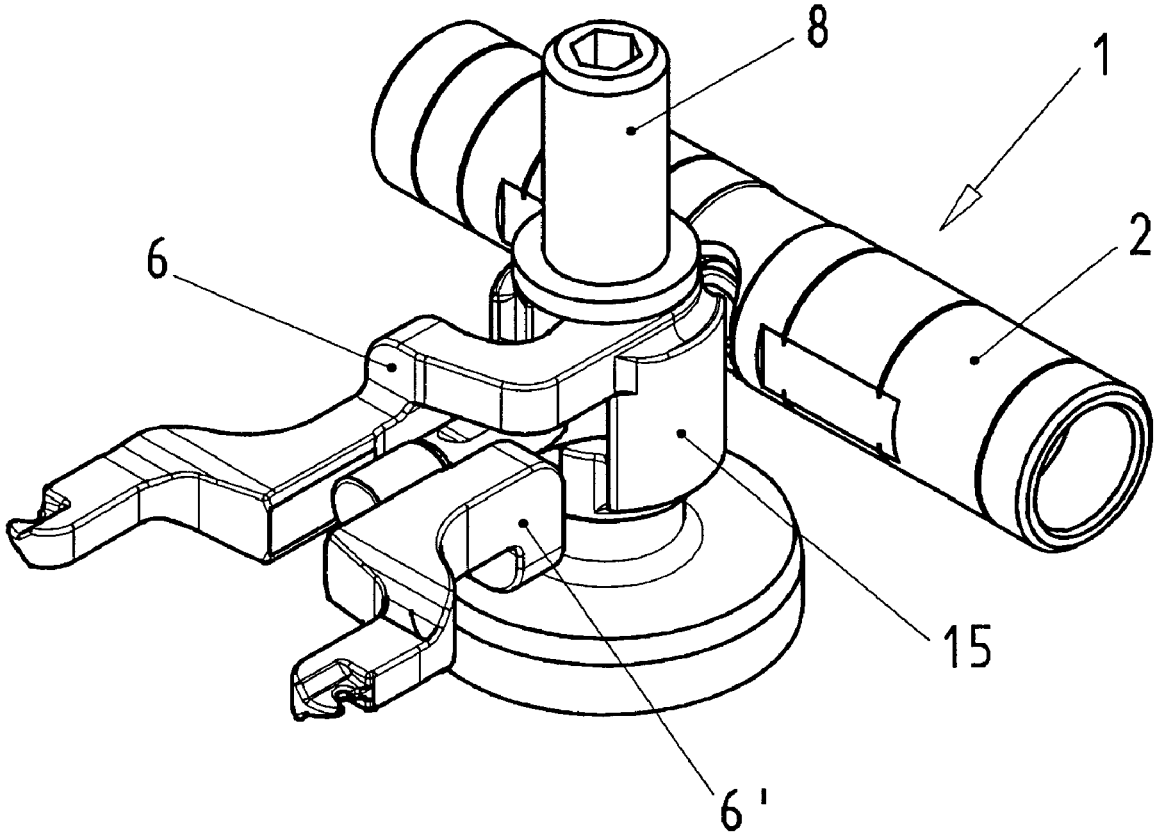

FIG. 2 shows the adjustment device in a section which is perpendicular to FIG. 1. In what follows, the same reference symbols as in FIG. 1 are retained for identical components. In the adjustment device 1, the control piston 2 is moved by proportional magnets 12, 12', an oil flow which supplies the control piston being made available via the ducts 13, 13'.

The pointer 3 engages on one side of its pivot axis 5 in a bore in the control piston 2, the point of engagement of its end 4, which is of spherical construction, lying on the tappet axis of the magnets 12, 12' and thus being offset with respect to the centre line of the control piston, in order to avoid tilting moments and rotation of the piston. There is a longitudinal bore through the centre of the control piston 2 along its centre line in order to conduct away oil escaping as a result of unavoidable leaks.

The pointer 3 engages between the spring levers 6, 6' on the side of the pivot axis facing away from the control piston 2, and said pointer 3 lies with its head 14 on part of the bearing faces 11, 11', which are specially processed, in particular coated, in order to avoid abrasion. The same applies to the pointer head 14, which is circular-cylindrical in the example shown but may also be embodied with a rectangular cross section or in the shape of a sphere. A pin (not illustrated) which is connected to the swashplate and transmits the latter's angular position rests on the part of the bearing faces 11, 11' which projects beyond the pointer head. When the control piston 2 moves, the pointer head 14 presses the spring levers 6, 6' apart from one another, counter to the resistance of the pin which is connected to the swashplate.

FIGS. 3*a* to 3*d* show different views of the embodiment of the adjustment device 1 according to the invention. The pointer 3 engages, on one side of its pivot axis 5, in the control piston 2, and on the other side with the cylindrical pointer head 14, between the spring levers 6, 6' and rests there on the coated bearing faces 11, 11'. The spring levers 6, 6' and pointer 3 are each mounted directly on the eccentric part 9 of the axial bolt 8. The spring levers 6, 6' are bent, each engage over the opposite side of the pointer 3 before the pivot axis 5 and each form a bearing shell 15, each of which is composed in turn of two separate component shells between which the pointer 3 is held. The bearing shells 15 each essentially enclose, i.e. with the exception of a clearance angle which is necessary for sufficient spreading of the spring levers, a half-space about the pivot axis 5. This results in a very compact symmetric bearing arrangement in which the spring levers 6, 6' can hardly tilt at all because they are each supported on the pivot axis at two locations by means of the divided bearing shells 15.

The invention results in an adjustment device which is a very compact construction, can be adjusted precisely and is resistant to tilting, it being possible to cover an entire series of axial piston machines having different volumetric displacements with one and the same adjustment device.

What is claimed is:

1. Axial piston machine having a swashplate or oblique axis which can be adjusted by means of servopistons and has a valve segment and an adjustment unit for the electrically proportional adjustment of the volumetric displacement, the adjustment unit comprising proportional magnets (12, 12') which can be activated electrically, and a control piston (2) for controlling the oil pressure which moves the servopistons, the proportional magnets (12, 12') acting on the control piston (2) along a common tappet axis, and a feedback device for feeding back the current swashplate or oblique-axis valve-segment position to the control piston (2) being provided, and the feedback device comprising spring levers (6, 6') which can pivot about an axis (5), the spring levers (6, 6') each being mounted on the pivot axis (5) with a bearing shell (15), which are each composed of two component shells which support the spring lever (6, 6') at separate locations on the pivot axis (5), and which each essentially enclose a half-space about the pivot axis (5); wherein the feedback device further comprises a pointer (3) which is embodied as a two-armed lever and which can pivot about the pivot axis (5), the pointer (3) engaging in the control piston (2) on one side of the pivot axis (5), and between the spring lever (6, 6') on the other side; and wherein the pointer (3) is mounted on the spring levers (6, 6').

2. Axial piston machine according to claim 1, further comprising a pointer head (14) and faces (11, 11') of the spring levers (6, 6') on which the pointer (3) rests with the pointer head (14) being separately processed in order to reduce friction.

3. Axial piston machine according to claim 2, the pointer head (14) being of cylindrical construction.

4. Axial piston machine according to claim 2, the pointer head (14) being of spherical construction.

5. Axial piston machine according to claim 2, the pointer head (14) having a rectangular cross section.

6. Axial piston machine according to one of claim 1, the end of the pointer (3) which engages in the control piston (2) being of spherical construction.

7. Axial piston machine according to one of claim 1, the point of engagement of the pointer (3) in the control piston (2) lying outside the piston centre line.

8. Axial piston machine according to one of claim 1, the point of engagement of the pointer in the control piston (2) lying on the tappet axis of the magnets (12, 12').

9. Axial piston machine according to one of claim 1, the control piston (2) having, along its length, a bore through which leakage oil can be conducted away.

* * * * *